US010229799B2

(12) United States Patent
Seto et al.

(10) Patent No.: US 10,229,799 B2
(45) Date of Patent: Mar. 12, 2019

(54) HYDRAULIC DRIVE FOR A SWITCHGEAR

(71) Applicant: HITACHI, LTD., Tokyo (JP)

(72) Inventors: Shinji Seto, Tokyo (JP); Daisuke Ebisawa, Tokyo (JP); Hiroaki Hashimoto, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 15/552,590

(22) PCT Filed: Feb. 10, 2016

(86) PCT No.: PCT/JP2016/053879
§ 371 (c)(1),
(2) Date: Aug. 22, 2017

(87) PCT Pub. No.: WO2016/143453
PCT Pub. Date: Sep. 15, 2016

(65) Prior Publication Data

US 2018/0025867 A1 Jan. 25, 2018

(30) Foreign Application Priority Data

Mar. 6, 2015 (JP) ..... 2015-044303

(51) Int. Cl.
*H01H 33/34* (2006.01)
*H01H 33/30* (2006.01)
*H01H 3/30* (2006.01)

(52) U.S. Cl.
CPC ..... *H01H 33/34* (2013.01); *H01H 3/3026* (2013.01); *H01H 33/30* (2013.01); *H01H 33/302* (2013.01)

(58) Field of Classification Search
CPC ..... H01H 33/34; H01H 33/28; H01H 33/30; H01H 33/302; H01H 3/3026; G15B 13/0431
(Continued)

(56) References Cited

U.S. PATENT DOCUMENTS 4,162,385 A 7/1979 Bould et al.
4,952,759 A * 8/1990 Perret ..... H01H 3/3026 188/282.2
(Continued)

FOREIGN PATENT DOCUMENTS

JP 53-043870 A 4/1978
JP 2004-220821 A 8/2004
(Continued)

OTHER PUBLICATIONS

International Search Report of PCT/JP2016/053879 dated May 17, 2016.

*Primary Examiner* — Vanessa Girardi
(74) *Attorney, Agent, or Firm* — Mattingly & Malur, PC

(57) ABSTRACT

A switchgear driving device has a rod coupled to a movable electrode; an operation piston connected to the rod; and an operation cylinder in which an operation piston slides. A main control valve controls the pressure of the hydraulic oil in the operation cylinder. A turning-on pressure accumulation piston slides inside a turning-on pressure accumulation chamber; and a turning-on pressure accumulation spring imparts a driving force to the turning-on pressure accumulation piston to pressurize the hydraulic oil within the turning-on pressure accumulation chamber. A turning-off pressure accumulation piston slides inside a turning-off pressure accumulation chamber. A turning-off pressure accumulation spring imparts a driving force to the turning-off pressure accumulation piston to pressurize the hydraulic oil in the turning-off pressure accumulation chamber. A spring case accommodates the turning-on pressure accumulation spring and the turning-off pressure accumulation spring, wherein the turning-off pressure accumulation spring is arranged inside the turning-on pressure accumulation spring.

14 Claims, 5 Drawing Sheets

(58) Field of Classification Search
USPC ..... 200/81 R, 82 R; 218/93
See application file for complete search history.

(56) References Cited

U.S. PATENT DOCUMENTS

| | | | | |
|---|---|---|---|---|
| 6,875,941 | B2 * | 4/2005 | Kawamoto | H01H 33/34 200/82 B |
| 7,121,297 | B2 * | 10/2006 | Thoms | F15B 11/0413 137/489 |
| 2005/0006349 | A1 | 1/2005 | Kawamoto et al. | |
| 2012/0228103 | A1 | 9/2012 | Staffas et al. | |

FOREIGN PATENT DOCUMENTS

| | | | |
|---|---|---|---|
| JP | 2011-009126 | A | 1/2011 |
| JP | 2013-510396 | A | 3/2013 |

* cited by examiner

HYDRAULIC DRIVE FOR A SWITCHGEAR

TECHNICAL FIELD

The present invention relates to a switchgear driving device and, in particular, to a switchgear driving device suitable for the type of switchgear in which the opening/closing operation on the electric current shut-off part is hydraulically conducted.

BACKGROUND ART

Regarding a switchgear such as a gas-insulated switchgear having an electric current shut-off part, there exists, for example, as a driving device for driving a moving contact constituting the electric current shut-off part, a hydraulic operation device which is equipped with a pressure accumulator using a compressed gas such as $N_2$ gas and which causes a pressure oil due to this pressure accumulator to act on a piston to perform the opening/closing operation, or a spring operation device which exerts the repulsive force of an energy storing coil spring or a disk spring to perform the opening/closing operation.

Of these, in the hydraulic operation device, a compressed gas such as $N_2$ gas is used in the pressure accumulator serving as the drive source, so that the gas undergoes expansion/contraction due to a change in the ambient temperature, and, in some cases, the hydraulic oil pressure undergoes fluctuation. On the other hand, the spring operation device requires a complicated mechanism, which involves a large number of components, making it necessary, in some cases, to conduct maintenance (See Patent Document 1).

Meanwhile, there is known a hydraulic operation device which utilizes no compressed gas and in which there is provided a mechanism effecting pressure accumulation by a turning-off pressure accumulation spring and a turning-on pressure accumulation spring such that the hydraulic oil pressure does not undergo fluctuation due to a change in the ambient temperature, thus reducing the complicated mechanism part (See Patent Document 2).

Further, Patent Document 3 discloses a device which is not a hydraulic operation device but a spring type operation device and in which an opening spring is arranged on the radial side of a closing spring.

PRIOR ART DOCUMENTS

Patent Documents

Patent Document 1: JP-2011-9126-A
Patent Document 2: JP-2004-220821-A
Patent Document 3: JP-2013-510396-T

SUMMARY OF THE INVENTION

Problems to be Solved by the Invention

It should be noted, however, that in the hydraulic operation device disclosed in Patent Document 2, in which the complicated mechanism part as required in Patent Document 1 is reduced to prevent an increase in the number of components, there are installed the turning-off pressure accumulation spring and the turning-on pressure accumulation spring, which are installed at different positions, so that there is the possibility of the size of the device being increased. Further, Patent Document 3 discloses a spring type operation device, and acknowledges the existence of no such problems as involved in a hydraulic operation device.

The present invention has been made in view of the above problems. It is an object of the present invention to provide a switchgear driving device which is not influenced by the ambient temperature and which is small and of high reliability.

Means for Solving the Problems

To achieve the above object, there is provided, according to the present invention, a switchgear driving device which effects the turning-on/off of contacts including a stationary electrode and a movable electrode by using a hydraulic oil. The switchgear driving device includes: a rod coupled to the movable electrode; an operation piston connected to the rod; a fluid pressure mechanism part including an operation cylinder in which the operation piston slides, a turning-on pressure accumulation chamber and a turning-off pressure accumulation chamber effecting pressure accumulation on the hydraulic oil for turning-on/off, and a main control valve controlling the pressure of the hydraulic oil in the operation cylinder; a turning-on pressure accumulation piston sliding in the turning-on pressure accumulation chamber; a turning-on pressure accumulation spring which imparts a driving force to the turning-on pressure accumulation piston to pressurize the hydraulic oil within the turning-on pressure accumulation chamber; a turning-off pressure accumulation piston sliding inside the turning-off pressure accumulation chamber; a turning-off pressure accumulation spring which imparts a driving force to the turning-off pressure accumulation piston to pressurize the hydraulic oil in the turning-off pressure accumulation chamber; and a spring case accommodating the turning-on pressure accumulation spring and the turning-off pressure accumulation spring. The turning-off pressure accumulation spring is arranged inside the turning-on pressure accumulation spring.

Effect of the Invention

According to the present invention, it is possible to provide a switchgear driving device which is not influenced by the ambient temperature and which is small and of high reliability.

MODES FOR CARRYING OUT THE INVENTION

Figure 1:
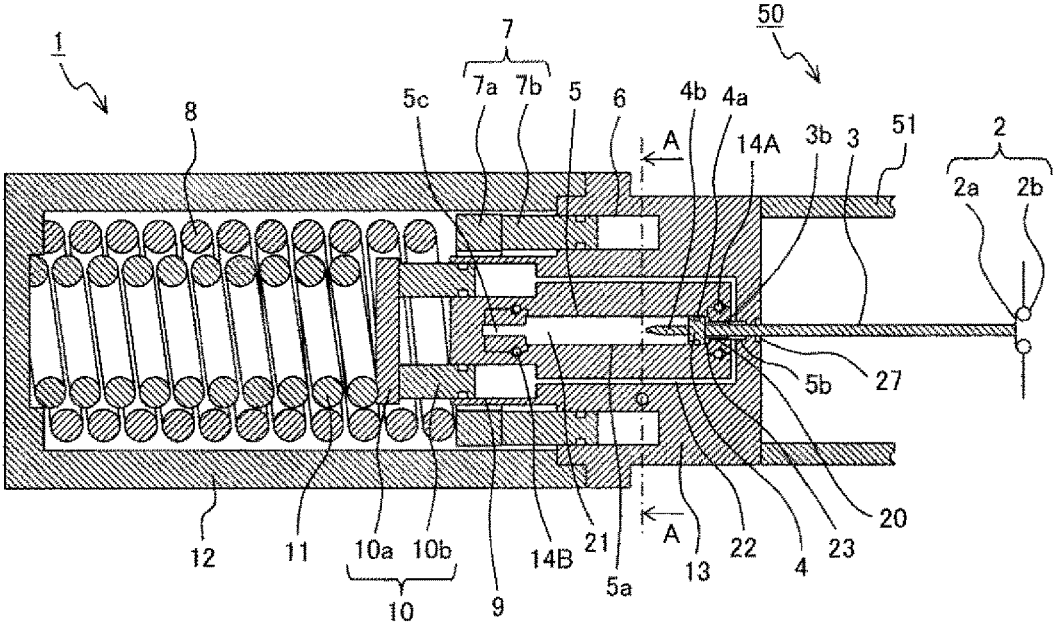
FIG. 1 is a longitudinal sectional view (taken along line B-B of FIG. 2) in the closed state of a gas circuit breaker driving device which is an embodiment 1 of the switchgear driving device according to the present invention.

In the following, the switchgear driving device according to the present invention will be described based on the embodiments shown in the drawings. In the embodiments, the same components are indicated by the same reference characters.

Embodiment 1

Figure 2:
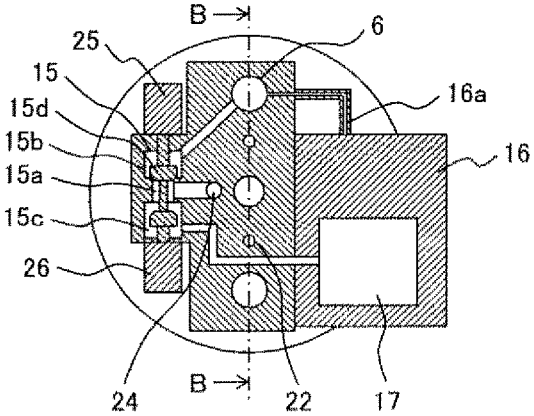
FIG. 2 is a sectional view, taken along line A-A of FIG. 1, in the closed state, of the gas circuit breaker driving device which is the embodiment 1 of the switchgear driving device according to the present invention.
Figure 3:
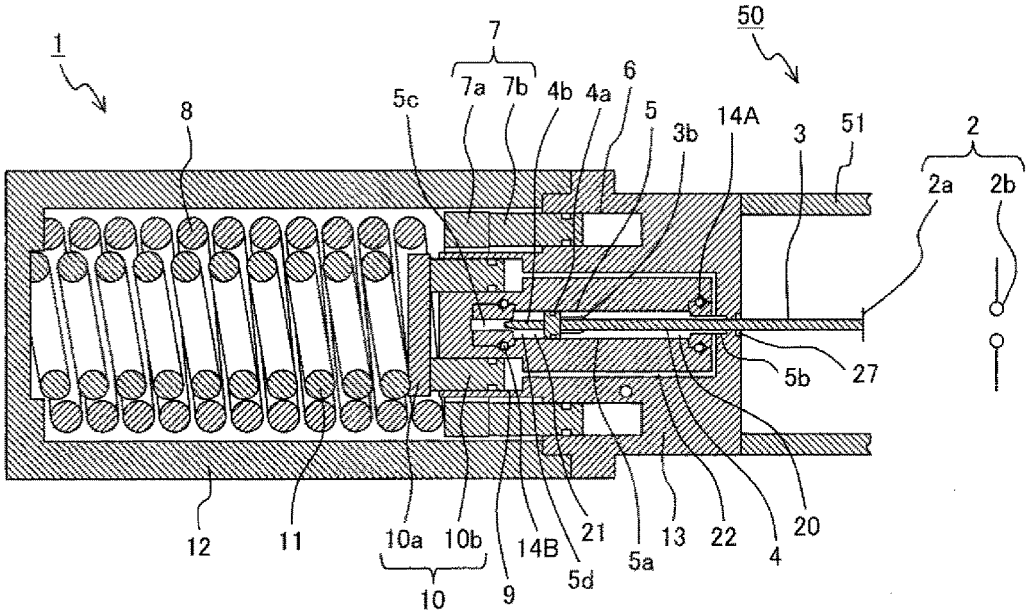
FIG. 3 is a longitudinal sectional view, during opening operation, of the gas circuit breaker driving device which is the embodiment 1 of the switchgear driving device according to the present invention.
Figure 4:
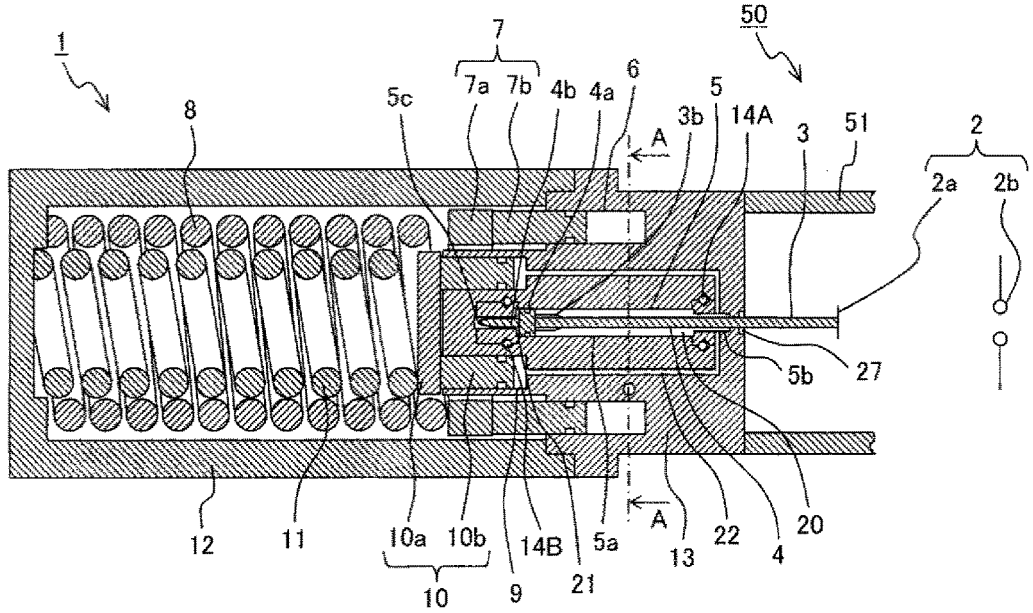
FIG. 4 is a longitudinal sectional view (taken along line B-B of FIG. 5) in the open state of the gas circuit breaker driving device which is the embodiment 1 of the switchgear driving device according to the present invention.
Figure 5:
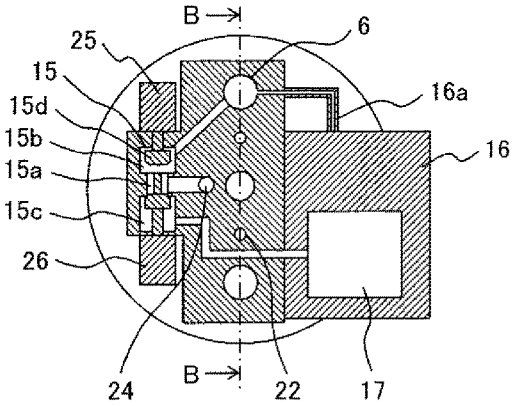
FIG. 5 is a sectional view, taken along line A-A of FIG. 4, in the open state, of the gas circuit breaker driving device which is the embodiment 1 of the switchgear driving device according to the present invention.
Figure 6:
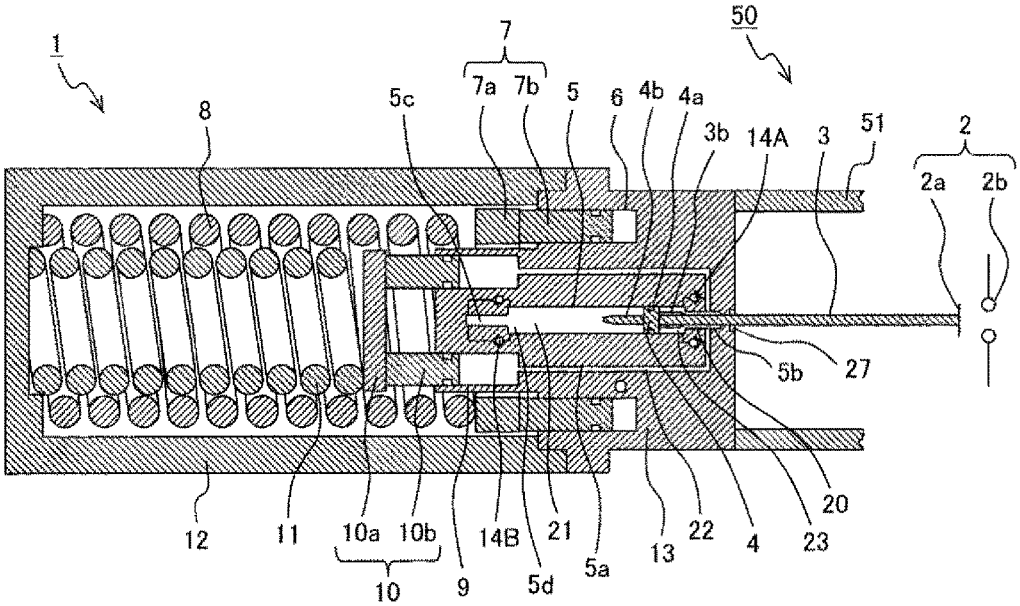
FIG. 6 is a longitudinal sectional view, during opening operation, of the gas circuit breaker driving device which is the embodiment 1 of the switchgear driving device according to the present invention.
Figure 7:
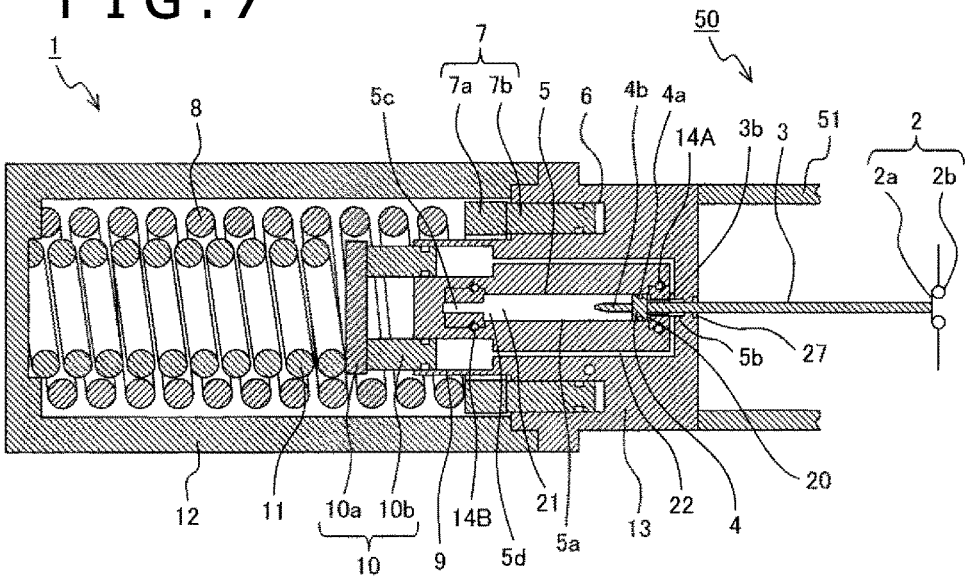
FIG. 7 is a longitudinal sectional view of the gas circuit breaker driving device which is the embodiment 1 of the switchgear driving device according to the present invention, with the closing operation completed.

FIGS. 1 through 7 show a gas circuit breaker driving device according to an embodiment 1 of the switchgear driving device of the present invention. FIGS. 1 and 2 show the gas circuit breaker driving device in a closed, energized state. FIG. 3 shows that in a state in which an opening operation is being performed; FIGS. 4 and 5 show that in a state in which the opening operation has been completed; FIG. 6 shows that in a state in which a closing operation is being performed; and FIG. 7 shows that in a state in which the closing operation has been completed.

Generally speaking, as shown in FIG. 1, the gas circuit breaker can be divided into a shut-off part 50 and a driving device 1 driving this shut-off part 50. The shut-off part 50 has contacts 2 including a stationary electrode 2*b* and a movable electrode 2*a* inside a hermetic container 51 filled with a gas excellent in insulation characteristics such as $SF_6$ gas. On the other hand, the driving device 1 generally includes: a rod 3 connected to the shut-off part 50; an operation piston 4 connected to the rod 3; a fluid pressure mechanism part 13 in which there are arranged an operation cylinder 5 in which the operation piston 4 slides, a turning-on pressure accumulation chamber 6 effecting pressure accumulation on a hydraulic fluid, a turning-off pressure accumulation chamber 9, a main control valve 15 controlling the pressure in the operation cylinder 5, etc.; a turning-on pressure accumulation piston 7 sliding inside the turning-on pressure accumulation chamber 6; a turning-on pressure accumulation spring 8 which imparts a driving force to the turning-on pressure accumulation piston 7 to pressurize a fluid (hydraulic oil) within the turning-on pressure accumulation chamber 6; a turning-off pressure accumulation piston 10 sliding inside the turning-off pressure accumulation chamber 9; a turning-off pressure accumulation spring 11 which imparts a driving force to the turning-off pressure accumulation piston 10 to pressurize the fluid (hydraulic oil) within the turning-off pressure accumulation chamber 9; and a spring case 12 accommodating a pump unit 16 recovering and pressurizing the discharged fluid (hydraulic oil), the turning-on pressure accumulation spring 8, and the turning-off pressure accumulation spring 11.

The spring case 12 is formed as a tube having a bottom section at its one end, and on the open side opposite the bottom section of the spring case 12, there is arranged the fluid pressure mechanism part 13 so as to close it. This fluid pressure mechanism part 13 is fixed to the hermetic container 51 and arranged in a fixed manner together with the spring case 12; in the fluid pressure mechanism part 13, there are arranged the main control valve 15, the operation cylinder 5, the turning-on pressure accumulation chamber 6, the turning-off pressure accumulation chamber 9, and piping connecting them to each other.

The turning-on pressure accumulation chamber 6 and the turning-off pressure accumulation chamber 9 are formed as at least one cylindrical hole and is formed so as to exhibit an open section to the inner side of the spring case 12. In the case where there are formed a plurality of turning-on pressure accumulation chambers 6, the turning-on pressure accumulation chambers 6 are connected to each other by conduit lines (not shown). Similarly, in the case where there are formed a plurality of turning-off pressure accumulation chambers 9, the turning-off pressure accumulation chambers 9 are connected to each other by conduit lines (not shown).

The operation piston 4 can slide inside the operation cylinder 5, and the interior of the operation cylinder 5 is divided into a cylinder small pressure receiving area chamber 20 placed on the rod 3 side and a cylinder control chamber 21 placed on the opposite side.

The pressure of the hydraulic oil pressure-accumulated in the turning-off pressure accumulation chamber 9 acts on the cylinder small pressure receiving area chamber 20 via a conduit line (path) 22.

The main control valve 15 is provided between the cylinder control chamber 21 and the turning-on pressure accumulation chamber 6, and is equipped with a switching port 15*a* connected to the cylinder control chamber 21, a high-pressure port 15*b* connected to the turning-on pressure accumulation chamber 6, and a low-pressure port 15*c* connected to a low-pressure tank 17. The main control valve 15 is constructed such that, through the movement of a valve body 15*d*, selection is possible between the connection to the high-pressure port 15*b* of the switching port 15*a* and the connection to the low-pressure port 15*c*, and such that through this selection, the pressure of the cylinder control chamber 21 is controlled. The movement of the valve body 15*d* is effected through driving by an opening driving part 25 and a closing driving part 26.

The opening driving part 25 and the closing driving part 26 may be of a construction in which a pilot valve or the like is provided and driving is effected by changing the liquid pressure applied to the valve body 15*d* or of a construction in which there is adopted a solenoid or the like driven by an electromagnetic force.

The cylinder control chamber 21 is connected to a conduit line 24 connected to the switching port 15*a* via a conduit line (not shown).

The turning-on pressure accumulation piston 7 includes a disk part 7*a* having a hole at its center, and an at least one cylindrical part 7*b* formed so as to protrude toward the disk part 7*a*, with the cylindrical part 7*b* being arranged so as to be capable of sliding inside the turning-on pressure accumulation chamber 6.

One end of the turning-on pressure accumulation spring 8 is arranged so as to be in contact with the side of the disk part 7*a* of the turning-on pressure accumulation piston 7 on the opposite side of the cylindrical part 7*b*. The turning-on pressure accumulation spring 8 is constituted by a compression coil spring, and is arranged inside the spring case 12; one end thereof is in contact with the bottom section of the spring case 12, and the other end thereof is in contact with the disk part 7*a* of the turning-on pressure accumulation piston 7; a force is applied to the turning-on pressure accumulation piston 7 in a direction so as to pressurize the turning-on pressure accumulation chamber 6 to compress the fluid within the turning-on pressure accumulation chamber 6.

The turning-off pressure accumulation piston 10 includes a disk part 10*a*, and at least one cylindrical part 10*b* of a configuration protruding from this disk part 10*a*, with the cylindrical part 10*b* being arranged so as to be capable of sliding inside the turning-off pressure accumulation chamber 9.

The turning-off pressure accumulation spring 11 is constituted by a compression coil spring, and is arranged in the spring case 12; one end thereof is in contact with the bottom section of the spring case 12, and the other end thereof is in contact with the turning-off pressure accumulation piston 10; due to the releasing force of the spring, the turning-off pressure accumulation piston 10 pressurizes the turning-off pressure accumulation chamber 9 to exert a force in a direction so as to compress the hydraulic oil within the turning-off pressure accumulation chamber 9.

The turning-off pressure accumulation spring 11 is concentrically installed inside the turning-on pressure accumulation spring 8, and the turning-off pressure accumulation piston 10 is arranged so as to be capable of moving inside the hole formed in the disk part 7*a* of the turning-on pressure accumulation piston 7. Further, with the center of the turning-off pressure accumulation spring 11 and of the turning-on pressure accumulation spring 8 being the reference, there are arranged on the inner side the turning-off pressure accumulation chamber 9 and the cylindrical part 10*b* of the turning-off pressure accumulation piston 10, and there are arranged on the outer side the turning-on pressure accumulation chamber 6 and the cylindrical part 7*b* of the turning-on pressure accumulation piston 7.

The operation cylinder 5 is provided on the inner side of the turning-off pressure accumulation chamber 9 of the fluid pressure mechanism part 13, and this operation cylinder 5 is provided with a large-diameter part 5*a* in which the operation piston 4 slides, and with, at a cylinder small pressure receiving area chamber 20 side end section, a cylinder small pressure receiving area chamber side small-diameter part 5*b* which is of a smaller diameter than the large-diameter part 5*a*. On the other hand, also at the cylinder control chamber 21 side end section, there is provided a cylinder control chamber side small-diameter part 5*c* which is of a smaller diameter than the large-diameter part 5*a*. Further, the turning-off pressure accumulation chamber 9 is connected to the cylinder small pressure receiving area chamber side small-diameter part 5*b* via a conduit line 22.

The operation piston 4 is provided with a sliding part 4*a* sliding in the large-diameter part 5*a* of the operation cylinder 5, and a protrusion 4*b* on the cylinder control chamber 21 side; the protrusion 4*b* is constructed so as to be gradually diminished in sectional area as it extends away from the sliding part 4*a*. The rod 3 is formed with a diameter-increased part 3*b* the diameter of which is fixed or gradually increased from the movable electrode 2*a* side.

Further, between the end section of the cylinder small pressure receiving area chamber side small-diameter part 5*b* and the cylinder small pressure receiving area chamber side small-diameter part 5*b* side end section of the large-diameter part 5*a* of the cylinder small pressure receiving area chamber 20, there is provided a first check valve 14A allowing flow in one direction only from the end section of the cylinder small pressure receiving area chamber side small-diameter part 5*b* to the large-diameter part 5*a*. Further, between the end section of the cylinder control chamber small-diameter part 5*c* and the cylinder control chamber small-diameter part 5*c* side end section of the large-diameter part 5*a*, there is provided a second check valve 14B allowing flow in one direction only from the end section of the cylinder control chamber small-diameter part 5*c* to the large-diameter part 5*a*.

Arranged in the sliding part of the fluid pressure mechanism part 13 for the rod 3 is a seal member 27 effecting sealing between the $SF_6$ gas and the fluid.

Next, the operation of the gas circuit breaker driving device according to the above-described embodiment will be described.

First, the closed state of the gas circuit breaker driving device shown in FIGS. 1 and 2 will be described.

In the drawings, a fluid is sealed in the turning-on pressure accumulation chamber 6, and the turning-on pressure accumulation spring 8 is maintained in a state in which it is compressed by the high pressure of the fluid of the turning-on pressure accumulation chamber 6 via the turning-on pressure accumulation piston 7. The main control valve 15 is maintained in a state in which the turning-on pressure accumulation chamber 6 and the cylinder control chamber 21 are connected to each other, and the high pressure of the turning-on pressure accumulation chamber 6 is applied to the cylinder control chamber 21. Thus, a force is applied to the operation piston 4 from the cylinder control chamber 21 side in a direction so as to maintain the closed state.

When the operation piston 4 is in the closed state, the cylinder small pressure receiving area chamber 20 side volume is minimum, and, accordingly, the volume of the turning-off pressure accumulation chamber 9 is maximum, whereby the turning-off pressure accumulation spring 11 is held in a state in which it is compressed to the utmost via the turning-off pressure accumulation piston 10. At this time, the diameter-increased part 3*b* of the rod 3 is in a state in which it is inserted into the cylinder small pressure receiving area chamber side small-diameter part 5*b*.

In this state, when the opening driving part 25 receives an opening command, the valve body 15*d* is operated by the driving force of the opening driving part 25, and there is attained an opening operation state in which the cylinder control chamber 21 is connected to the low-pressure tank 17 side.

As a result, by the force due to the pressure of the cylinder small pressure receiving area chamber 20 connected to the turning-off pressure accumulation chamber 9, the operation piston 4 operates in the opening direction, and the hydraulic oil in the cylinder control chamber 21 is discharged to the tank 17. Along with the operation of the operation piston 4, the hydraulic oil of the turning-off pressure accumulation chamber 9 flows into the cylinder small pressure receiving area chamber 20 via a gap between the first check valve 14A and the increased-diameter part 3*b* and the cylinder small pressure receiving area chamber side small-diameter part 5*b*. Further, the force of the turning-off pressure accumulation spring 11 acts on the turning-off pressure accumulation piston 10, so that, with the movement of the hydraulic oil, the turning-off pressure accumulation piston 10 also operates in a direction so as to force the hydraulic oil to the cylinder small pressure receiving area chamber 20 side.

As shown in FIG. 3, when the operation of the operation piston 4 progresses, and the distal end of the protrusion 4*b* of the operation piston 4 begins to be inserted into the cylinder control chamber small-diameter part 5*c*, a buffer chamber 5*d* is formed between the end section of the large-diameter part 5*a* of the operation cylinder 5 and the end section of the protrusion 4*b* of the operation piston 4.

In this buffer chamber 5*d*, the hydraulic oil is trapped except for the gap between the protrusion 4*b* and the cylinder control chamber small-diameter part 5*c*, and the hydraulic oil trapped in is compressed, so that the pressure begins to increase, and there is generated a force braking the operation piston 4.

The length of the protrusion 4*b* is determined such that the position of the operation piston 4 is enabled to generally coincide with the position where the operation piston 4 is desired to start the braking, and setting for desired increase in pressure can be made through a change in the diameter of the protrusion 4*b*. Then, there is attained the open state of the gas circuit breaker driving device as shown in FIGS. 4 and 5. That is, the operation piston 4 is placed at the position in the open state, and, as compared with the closed state, the turning-off pressure accumulation spring 11 is elongated, with the turning-off pressure accumulation piston 10 being placed at a position where the volume of the turning-off pressure accumulation chamber 9 is diminished. At this time, the turning-on pressure accumulation piston 7 and the turning-on pressure accumulation spring 8 do not operate.

Next, in the open state of the gas circuit breaker driving device shown in FIGS. 4 and 5, when a closing driving part 26 receives a closing command, the valve body 15*d* is operated by the driving force of the closing driving part 26, and there is attained a closing operation state in which the cylinder control chamber 21 is connected to the high-pressure turning-on pressure accumulation chamber 6 side.

As a result, a high-pressure fluid flows into the cylinder control chamber 21 from the turning-on pressure accumulation chamber 6 via the gap between the second check valve 14B and the protrusion 4*b* and the cylinder control chamber side small-diameter part 5*c*. When there is attained a cylinder control chamber 21 pressure where the force applied in the opening direction from the cylinder small pressure receiving area chamber 20 side is generally the same as the force applied in the closing direction from the cylinder control chamber 21 side, the operation piston 4 starts the closing operation.

At this time, the hydraulic oil from the turning-on pressure accumulation chamber 6 is supplied to the cylinder control chamber 21 by being forced in via the turning-on pressure accumulation piston 7 by the releasing force of the turning-on pressure accumulation spring 8. Thus, the turning-on pressure accumulation spring 8 is placed in an elongated state, and the turning-on pressure accumulation piston 7 moves to the turning-on pressure accumulation chamber 6.

As shown in FIG. 6, when the operation piston 4 operates in the closing direction, and the diameter-increased part 3*b* begins to be inserted into the cylinder small pressure receiving area chamber side small-diameter part 5*b*, a buffer chamber 23 is formed between the end of the large-diameter part 5*a* and the operation piston 4. Since the first check valve 14A maintains a closed state, the hydraulic oil is trapped in the buffer chamber 23 except for the gap between the diameter-increased part 3*b* and the cylinder small pressure receiving area chamber side small-diameter part 5*b*, and the trapped hydraulic oil is compressed, so that the pressure begins to increase, and there is generated a force braking the operation piston 4. The length of the diameter-increased part 3*b* is determined such that the position of the operation piston 4 is enabled to generally coincide with the position where the operation piston 4 is desired to start the braking. Further, setting can be made such that the buffer chamber 23 undergoes a desired increase in pressure through a change in the diameter of the protrusion 4*b*.

Through this operation of the operation piston 4, the fluid on the cylinder small pressure receiving area chamber 20 side flows into the turning-off pressure accumulation chamber 9, and the turning-off pressure accumulation piston 10 moves, with the turning-off pressure accumulation spring 11 being gradually compressed. Then, the movement of the operation piston 4 is completed, and the closed state of the gas circuit breaker driving device as shown in FIG. 7 is attained.

When, in this state, an opening command is input again, the opening operation can be performed in the same manner as described above since the turning-off pressure accumulation spring 11 is compressed.

Next, the pressure accumulating operation will be described.

After the completion of the closing operation, the turning-on pressure accumulation spring 8 is in the elongated state, so that it needs to be compressed. A discharge port 16*b* of a pump unit 16 is connected to the turning-on pressure accumulation chamber 6; by driving the pump, the hydraulic oil is supplied to the turning-on pressure accumulation chamber 6, and the turning-on pressure accumulation piston 7 is operated in the direction of the turning-on pressure accumulation spring 8; at the same time, the turning-on pressure accumulation spring 8 is compressed. As a result, the closed state of the gas circuit breaker driving device as shown in FIG. 1 is attained.

The relationship between the elements will be described.

The pressure of the turning-off pressure accumulation chamber 9 is generally a value obtained by dividing the force of the turning-off pressure accumulation spring 11 by the sectional area (pressure receiving area) receiving the pressure from the fluid, of the portion of the cylindrical part 10*b* of the turning-off pressure accumulation piston 10. What is obtained by multiplying this pressure by the sectional area (pressure receiving area) of the portion of the operation piston 4 where it receives pressure from the fluid at the cylinder small pressure receiving area chamber 20 is the driving force in the opening direction of the operation piston 4. From this, on the basis of the requisite driving force for the opening of a turning-off part 50, there is determined the relationship among the force of the turning-off pressure accumulation spring 11, the pressure receiving area of the turning-off pressure accumulation piston 10, and the pressure receiving area of the operation piston 4.

The pressure of the turning-on pressure accumulation chamber 6 is generally a value obtained by dividing the driving force of the turning-on pressure accumulation spring 8 by the sectional area receiving the pressure from the fluid, of the portion of the cylindrical part 7*b* of the turning-on pressure accumulation piston 7. By multiplying this pressure by the sectional area of the portion of the operation piston 4 where it receives the pressure from the hydraulic oil at the cylinder control chamber 21, the driving force in the closing direction of the operation piston 4 is derived. On the other hand, at the time of completion of the closing operation, the driving force in the closing direction of the operation piston 4 must be sufficiently larger than the driving force in the opening direction.

The relationship between the driving force of the turning-on pressure accumulation spring 8, the turning-off pressure accumulation piston 10, and the pressure receiving area of the turning-on pressure accumulation piston 7, the operation piston 4, etc. is derived so as to satisfy the above condition. In satisfying the above condition, setting is made such that the outer diameter of the turning-off pressure accumulation spring 11 is smaller than the inner diameter of the turning-on pressure accumulation spring 8.

As in the present embodiment described above, by arranging the turning-off pressure accumulation spring 11 and the turning-off pressure accumulation piston 10 inside the turning-on pressure accumulation spring 8 and the turning-on pressure accumulation piston 7, it is possible to achieve an overall reduction in size, making it possible to provide a gas circuit breaker driving device, which is not affected by the ambient temperature, and which is small and of high reliability.

Embodiment 2

Figure 8:
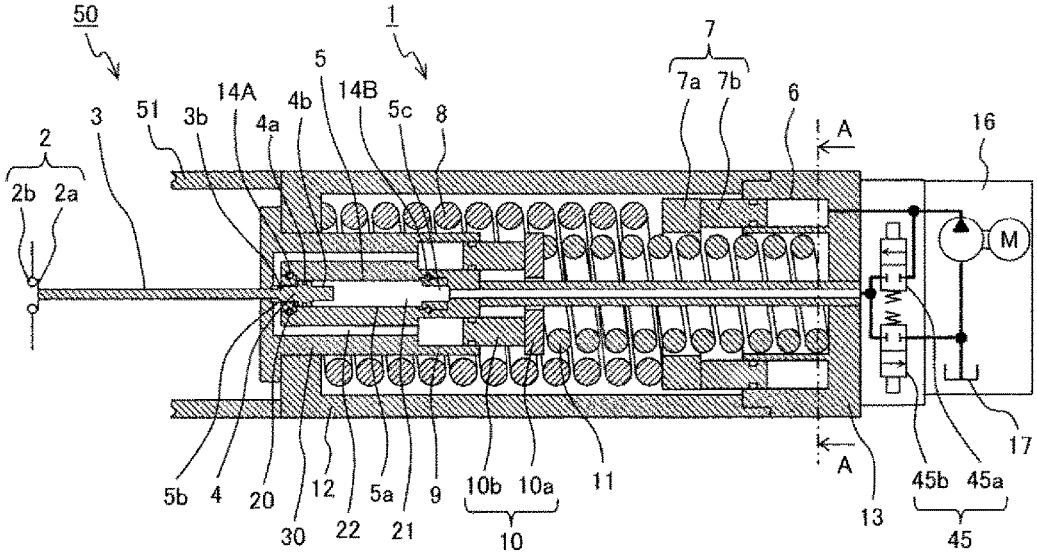
FIG. 8 is a longitudinal sectional view, in the closed state, of a gas circuit breaker driving device which is an embodiment 2 of the switchgear driving device according to the present invention.

FIG. 8 shows a gas circuit breaker driving device which is an embodiment 2 of the switch gear driving device according to the present invention. In the present embodiment shown in FIG. 8, the positional relationship etc. between a main control valve and a turning-off part, are modified from the construction of the embodiment 1. Further, of the gas circuit breaker driving device of FIG. 8, descriptions for the portions having the same functions and indicated by the same reference characters as those of the components in the embodiment 1 described above will be left out.

The gas circuit breaker driving device of the present embodiment shown in the drawing generally includes: a rod 3 opening/closing the contacts 2; an operation piston 4 connected to this rod 3; an operation cylinder 5 in which the operation piston 4 slides; a turning-on pressure accumulation chamber 6 effecting pressure accumulation on the hydraulic oil; a turning-off pressure accumulation chamber 9 effecting pressure accumulation on the hydraulic oil; the main control valve 45 controlling the pressure inside the operation cylinder 5; a turning-on pressure accumulation piston 7 sliding inside the turning-on pressure accumulation chamber 6; a turning-on pressure accumulation spring 8 imparting a driving force to the turning-on pressure accumulation piston 7; a turning-off pressure accumulation piston 10 sliding inside the turning-off pressure accumulation chamber 9; a turning-off pressure accumulation spring 11 imparting a driving force to the turning-off pressure accumulation piston 10; a pump unit 16 recovering and pressurizing the discharged hydraulic oil; and a spring case 12 accommodating a turning-on pressure accumulation spring 8 and a turning-off pressure accumulation spring 11.

The spring case 12 is constituted in a cylindrical configuration having a bottom section, and the bottom section side of the spring case 12 is fixed to the hermetic container 51 or the like of the shut-off part 50. Further, a hole section is provided in the bottom section of the spring case 12, and the cylinder accommodating part 30 is fixed to this hole section; on the side opposite the bottom section of the spring case 12, there is arranged the fluid pressure mechanism part 13, which is fixed in position.

In the fluid pressure mechanism part 13, there are arranged the main control valve 45 and the turning-on pressure accumulation chamber 6 and piping connecting them to each other. At least one turning-on pressure accumulation chamber 6 is formed in a cylindrical hole configuration, and is constructed so as to have an open section to the inner side of the spring case 12. In the case where a plurality of turning-on pressure accumulation chambers 6 are constructed, they are connected to each other by piping (not shown). Further, on an inner side of the plurality of turning-on pressure accumulation chambers 6 of the fluid pressure mechanism part 13, one end side of the turning-off pressure accumulation spring 11 is arranged in contact therewith. Further, the main control valve 45 includes an opening main control valve **45*b* and a closing main control valve 45*a***.

The turning-on pressure accumulation piston 7 is formed by a disk part **7*a* having a hole formed at its center, and a plurality of cylindrical parts 7*b* of a configuration protruding toward the disk part 7*a*, and the cylindrical parts 7*b* are arranged so as to be capable of sliding inside the turning-on pressure accumulation chamber 6**.

One end of the turning-on pressure accumulation spring 8 is arranged in contact with the disk part **7*a* placed on the side opposite the cylindrical parts 7*b* of the turning-on pressure accumulation piston 7**.

The turning-on pressure accumulation spring 8 is constituted by a compression coil spring, and is arranged inside the spring case 12; one end thereof is in contact with the bottom section of the spring case 12, and the other end thereof is in contact with the disk part **7*a* of the turning-on pressure accumulation piston 7, with a force being applied to the turning-on pressure accumulation piston 7 in a direction so as to compress the hydraulic oil within the turning-on pressure accumulation chamber 6**.

The cylinder accommodating part 30 is of a columnar configuration and is arranged inside the turning-on pressure accumulation spring 8, and is fixed to the bottom section of the spring case 12. At the center of the columnar section of the cylinder accommodating part 30, there is provided the operation cylinder 5 in which the operation piston 4 can slide. Further, the cylinder accommodating part 30 is provided with a plurality of turning-off pressure accumulation chambers 9 of a cylindrical hole configuration each having an opening to the interior side of the spring case 12.

The turning-off pressure accumulation piston 10 is formed by a disk part **10*a*, and a plurality of cylindrical parts 10*b* of a configuration protruding toward the disk part 10*a*, with the cylindrical parts 10*b* being arranged so as to be capable of sliding inside the turning-off pressure accumulation chamber 9**.

The turning-off pressure accumulation spring 11 is constituted by a compression coil spring, and is arranged in the spring case 12; one end thereof is in contact with the fluid pressure mechanism part 13, and the other end thereof is in contact with a movable turning-off pressure accumulation piston 10; due to the releasing force of the turning-off pressure accumulation spring 11, a force is applied to the turning-off pressure accumulation piston 10 in a direction so as to compress the hydraulic oil within the turning-off pressure accumulation chamber 9. Further, the turning-off pressure accumulation spring 11 is installed inside the turning-on pressure accumulation spring 8 substantially concentrically, and the turning-off pressure accumulation spring 11 is arranged inside the hole provided in the disk part **7*a* of the turning-on pressure accumulation piston 7** so as to be capable of expanding and contracting.

Further, the closing main control valve **45*a* is arranged halfway through the flow path communicating the cylinder control chamber 21 with the turning-on pressure accumulation chamber 6, and opens and closes the flow path between them. On the other hand, the opening main control valve 45*b* is arranged halfway through the flow path communicating the cylinder control chamber 21 with the tank 17**, and opens and closes the flow path between them.

Though different from the embodiment 1 in the construction of the main control valve 45 and the arrangement of each part, the operation of the gas circuit breaker driving device is basically the same.

The main control valve 45 is of a different construction, so that the operation thereof will be described.

In the closed state, the closing main control valve 45*a* and the opening main control valve 45*b* maintain the closed state by the force of a spring (not shown), the hydraulic oil, etc.

When an opening command is issued, the opening main control valve 45*b* opens by the hydraulic oil pressure and an electromagnetic force, and the cylinder control chamber 21 is connected to the tank 17 side, whereby the pressure of the cylinder control chamber 21 is lowered, and the operation piston 4 performs the opening operation by the force due to the pressure of the cylinder small pressure receiving area chamber 20. The closing main control valve 45*a* maintains the closed state by the hydraulic oil pressure.

When the opening operation is completed, the opening main control valve 45*b* is closed by the force of a spring, the hydraulic oil or the like. The expanding/contracting operations of the turning-on pressure accumulation spring 8 and the turning-off pressure accumulation spring 11 in the opening operation, and the operations of the turning-on pressure accumulation piston 7, the turning-off pressure accumulation piston 10, the operation piston 4, etc. are the same as those in the embodiment 1.

When a closing command is issued in the open state, the closing main control valve 45*a* opens by the hydraulic oil pressure and an electromagnetic force, and the cylinder control chamber 21 is connected to the high-pressure turning-on pressure accumulation chamber 6 side, whereby the force due to the pressure of the cylinder control chamber 21 overcomes the force due to the pressure of the cylinder small pressure receiving area 20, and the operation piston 4 performs the closing operation.

The opening main control valve 45*b* is maintained in the closed state by the hydraulic oil pressure, and when the closing operation is completed, the closing main control valve 45*a* is closed by a spring, hydraulic oil pressure or the like.

The expanding/contracting operations of the turning-on pressure accumulation spring 8 and of the turning-off pressure accumulation spring 11, and the operations of the turning-on pressure accumulation piston 7, the turning-off pressure accumulation piston 10, the operation piston 4, etc. are the same as those in the embodiment 1.

While in the present embodiment the opening main control valve 45*b* and the closing main control valve 45*a* are used for the main control valve 45, the construction of the main control valve 15 as shown in the embodiment 1 may be employed. Further, the construction such as the main control valve 45 of the present embodiment may be employed in the main control valve 15 of the embodiment 1.

According to the present embodiment described above, the same effect as that of the embodiment 1 can of course be achieved; the main control valve 45 and the pump unit 16 can be installed on the side opposite the shut-off part 50, thus making it possible to increase the degree of freedom in installation.

Embodiment 3

Figure 9:
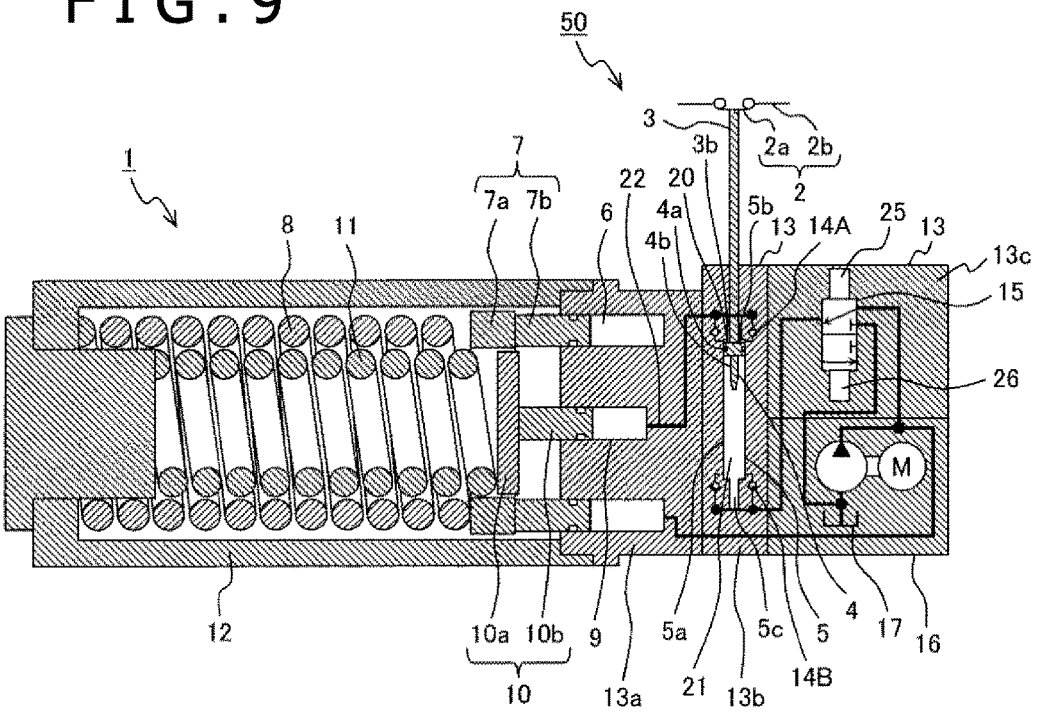
FIG. 9 is a longitudinal sectional view, in the closed state, of a gas circuit breaker driving device which is an embodiment 3 of the switchgear driving device according to the present invention.

FIG. 9 shows a gas circuit breaker driving device which is an embodiment 3 of the switch gear driving device of the present invention. The embodiment shown in FIG. 9 differs from the embodiment 1 in the positional relationship, etc. of a main control valve 15, an operation cylinder 5, a turning-on pressure accumulation chamber 6, a turning-off pressure accumulation chamber 9, etc. Further, of the gas circuit breaker driving device of FIG. 9, descriptions for the portions having the same functions and indicated by the same reference characters as those of the components in the embodiment 1 described above will be omitted.

The gas circuit breaker driving device of the present embodiment shown in the drawing generally includes: a rod 3 opening and closing the contacts 2; an operation piston 4 connected to this rod 3; the operation cylinder 5 in which the operation piston 4 slides; the turning-on pressure accumulation chamber 6 effecting pressure accumulation on a high-pressure hydraulic oil, the turning-off pressure accumulation chamber 9 effecting pressure accumulation on the high-pressure hydraulic oil; the main control valve 15 controlling the pressure within the operation cylinder 5; a turning-on pressure accumulation piston 7 sliding inside the turning-on pressure accumulation chamber 6; a turning-on pressure accumulation spring 8 imparting a driving force to the turning-on pressure accumulation piston 7; a turning-off pressure accumulation piston 10 sliding inside the turning-off pressure accumulation chamber 9; a turning-off pressure accumulation spring 11 imparting a driving force to the turning-off pressure accumulation piston 10; and a spring case 12 accommodating a pump unit 16 recovering and pressurizing the discharged fluid, the turning-on pressure accumulation spring 8, and the turning-off pressure accumulation spring 11.

The spring case 12 is constituted in a cylindrical configuration having a bottom section, and on the side opposite the bottom section, there is provided the fluid pressure mechanism part 13 so as to close the spring case 12. This fluid pressure mechanism part 13 includes a pressure accumulation chamber part 13*a*, a cylinder part 13*b*, and a main control valve part 13*c*.

The pressure accumulation chamber part 13*a* is equipped with at least one turning-on pressure accumulation chamber 6 formed by a cylindrical hole section open to the spring case 12 side, and at least one turning-off pressure accumulation chamber 9 formed by a cylindrical hole section open to the spring case 12 side.

Further, the cylinder part 13*b* is fixed to the pressure accumulation chamber part 13*a*, and is equipped with the operation cylinder 5 in which the operation piston 4 slides. The construction of the operation cylinder 5, the operation piston 4, etc. is the same as that of the embodiment 1. The operation cylinder 5 is installed so as to be at right angles to the operational direction of the turning-on pressure accumulation spring 8 and the turning-off pressure accumulation spring 11, and the operation piston 4 slides inside the operation cylinder 5 in a direction perpendicular to the operational direction of the turning-on pressure accumulation spring 8 and the turning-off pressure accumulation spring 11.

On the other hand, the main control valve part 13*c* is equipped with the main control valve 15. This main control valve 15 is of the same construction as that of the embodiment 1, and operates through a change in the hydraulic oil pressure due to an electromagnetic force or the operation of a pilot valve or the like, allowing selective connection of the cylinder control chamber 21 to the turning-on pressure accumulation chamber 6 side or to the tank 17 side.

While in FIG. 9 the cylinder part 13*b* is arranged on the right-hand side of the pressure accumulation chamber part

13*a*, it may also installed, for example, in front of or on the depth side of the pressure accumulation chamber part 13*a* and the spring case 12; further, also the main control valve part 13*c*, the pump unit 16, etc. may be installed on the front side, the depth side, the upper side, the lower side, etc., and the arrangement position of the cylinder part 13*b* should not be restricted to that of the drawing.

The operation of the gas circuit breaker driving device of the present embodiment is the same as that of the embodiment 1, and a description thereof will be left out.

According to the present embodiment described above, the same effect as that of the embodiment 1 can of course be achieved; further, selecting the installation position of the driving mechanism with respect to the shut-off part 50 is made to be possible, thus making it possible to meet various installation demands regarding the switchgear.

Further, the gas circuit breaker driving device according to the above embodiments can be utilized as a driving device for other switchgears such as a vacuum circuit breaker or a disconnecting switch, and is not restricted to the driving device for the gas circuit breaker.

The present invention is not restricted to the above embodiments but includes various modifications. For example, the above embodiments have been described in detail with a view to facilitating the understanding of the present invention, and they are not always restricted to examples equipped with all the components described above. Further, it is possible to replace a part of the construction of an embodiment by the construction of another embodiment; further, it is also possible to add the construction of another embodiment to the construction of an embodiment. Further, regarding a part of the construction of each embodiment, the addition of some other construction, deletion, and replacement are possible.

DESCRIPTION OF REFERENCE CHARACTERS

1: Driving device
2: Contacts
2*a*: Movable electrode
2*b*: Stationary electrode
3: Rod
3*b*: Diameter-increased part of the rod
4: Operation piston
4*a*: Sliding part of the operation piston
4*b*: Protrusion of the operation piston
5: Operation cylinder
5*a*: Large-diameter part of the operation cylinder
5*b*: Cylinder small pressure receiving area chamber side small-diameter part
5*c*: Cylinder control chamber side small-diameter part, 5*d*,
23: Buffer chamber
6: Turning-on pressure accumulation chamber
7: Turning-on pressure accumulation piston
7*a*: Disk part of the turning-on pressure accumulation piston
7*b*: Cylindrical part of the turning-on pressure accumulation piston
8: Turning-on pressure accumulation spring
9: Turning-off pressure accumulation chamber
10: Turning-off pressure accumulation piston
10*a*: Disk part of the turning-off pressure accumulation piston
10*b*: Cylindrical part of the turning-off pressure accumulation piston
11: Turning-off pressure accumulation spring
12: Spring case
13: Fluid pressure mechanism part
13*a*: Pressure accumulation chamber part
13*b*: Cylinder part
13*c*: Main control valve part
14A: First check valve
14B: Second check valve
15, 45: Main control valve
15*a*: Switching port
15*b*: High-pressure port
15*c*: Low-pressure port
15*d*: Valve body
16: Pump unit
16*b*: Discharge port of the pump unit
17: Tank
20: Cylinder small pressure receiving area chamber
21: Cylinder control chamber
22, 24: Conduit line
25: Opening driving part
26: Closing driving part
27: Seal member
30: Cylinder accommodating part
45*a*: Closing main control valve
45*b*: Opening main control valve
50: Shut-off part
51: Hermetic container

The invention claimed is:

1. A switchgear driving device that effects turning-on/off of contacts including a stationary electrode and a movable electrode by using a hydraulic oil, the switchgear driving device comprising:

a rod coupled to the movable electrode;

an operation piston connected to the rod;

a fluid pressure mechanism part including an operation cylinder in which the operation piston slides, a turning-on pressure accumulation chamber and a turning-off pressure accumulation chamber effecting pressure accumulation on the hydraulic oil for turning-on/off, and a main control valve controlling the pressure of the hydraulic oil in the operation cylinder;

a turning-on pressure accumulation piston sliding inside the turning-on pressure accumulation chamber;

a turning-on pressure accumulation spring that imparts a driving force to the turning-on pressure accumulation piston to pressurize the hydraulic oil within the turning-on pressure accumulation chamber;

a turning-off pressure accumulation piston sliding inside the turning-off pressure accumulation chamber;

a turning-off pressure accumulation spring that imparts a driving force to the turning-off pressure accumulation piston to pressurize the hydraulic oil in the turning-off pressure accumulation chamber; and a spring case accommodating the turning-on pressure accumulation spring and the turning-off pressure accumulation spring, wherein the turning-off pressure accumulation spring is arranged inside the turning-on pressure accumulation spring, wherein the turning-on pressure accumulation spring and the turning-off pressure accumulation spring are constituted by coil springs that are arranged concentrically, and wherein with a center of the turning-on pressure accumulation spring and of the turning-off pressure accumulation spring serving as a reference, the turning-off pressure accumulation chamber and the turning-off pressure accumulation piston are arranged on an inner side, and the turning-on pressure accumulation chamber and the turning-on pressure accumulation piston are arranged on an outer side.

2. The switchgear driving device according to claim 1, wherein the operation piston is configured such that an inside of the operation cylinder is divided into a small pressure receiving area chamber placed on a side of the contacts and a cylinder control chamber placed on a side opposite the small pressure receiving area chamber, the turning-off pressure accumulation chamber is connected to the small pressure receiving area chamber via a path through which the hydraulic oil passes, and the turning-off pressure accumulation piston is slidably arranged inside the turning-off pressure accumulation chamber, and the turning-off pressure accumulation spring is constructed such that an accumulated pressure of the turning-off pressure accumulation spring is imparted to the hydraulic oil in the turning-off pressure accumulation chamber via the turning-off pressure accumulation piston, and the turning-on pressure accumulation piston is slidably arranged inside the turning-on pressure accumulation chamber, and the turning-on pressure accumulation spring is constructed such that an accumulated pressure of the turning-on pressure accumulation spring is imparted to the hydraulic oil in the turning-on pressure accumulation chamber via the turning-on pressure accumulation piston.

3. The switchgear driving device according to claim 2, wherein the spring case is formed in a cylindrical configuration having a bottom section, and is equipped with a fluid pressure driving part arranged so as to close the spring case on the side opposite the bottom section of the spring case, with the fluid pressure mechanism part being constructed from a pressure accumulation chamber part, a cylinder part, and a main control valve part;

the pressure accumulation chamber part is equipped with the at least one turning-on pressure accumulation chamber formed by a cylindrical hole section open to the spring case side, and the at least one turning-off pressure accumulation chamber formed by a cylindrical hole section open to the spring case side;

the cylinder part is fixed to the pressure accumulation chamber part and equipped with thereinside an operation cylinder in which the operation piston slides;

the operation cylinder is installed so as to be perpendicular to an operational direction of the turning-on pressure accumulation spring and/or the turning-off pressure accumulation spring, and the operation piston slides inside the operation cylinder in a direction perpendicular to the operational direction of the turning-on pressure accumulation spring and/or the turning-off pressure accumulation spring, wherein the main control valve part operates through a change in the hydraulic oil pressure due to an operation of the main control valve, and allows a selective connection of the cylinder control chamber to the turning-on pressure accumulation chamber side or to a tank side.

4. The switchgear driving device according to claim 2, wherein the spring case is formed in a cylindrical configuration having a bottom section, and a hole section is provided at the bottom section of the spring case;

a cylinder accommodating part is fixed to the hole section; and the fluid pressure mechanism part is fixed to the side opposite the bottom section of the spring case.

5. The switchgear driving device according to claim 4, wherein in the fluid pressure mechanism part, a main control valve including an opening main control valve and a closing main control valve, the turning-on pressure accumulation chamber, and piping connecting them to each other are arranged;

the closing main control valve is arranged halfway through a flow path communicating the cylinder control chamber with the turning-on pressure accumulation chamber to each other, with the flow path between them being opened and closed; and the opening main control valve is arranged halfway through a flow path communicating the cylinder control chamber with the tank to each other, with the flow path between them being opened and closed.

6. The switchgear driving device according to claim 4, wherein the turning-on pressure accumulation chamber is formed as at least one chamber of a cylindrical configuration, and is formed so as to have an open section to the inner side of the spring case;

the turning-on pressure accumulation piston is equipped with a disk part having a hole formed at a center thereof, and at least one cylindrical part that is the same number as that of the turning-on pressure accumulation chamber, the cylindrical part having a configuration protruding toward the disk part;

the cylindrical parts are arranged so as to be capable of sliding inside the turning-on pressure accumulation chamber;

one end of the turning-on pressure accumulation spring is arranged in contact with the disk part on a side opposite the cylindrical parts of the turning-on pressure accumulation piston, and other end of the turning-on pressure accumulation spring is arranged in contact with the bottom section of the spring case, wherein the turning-off pressure accumulation piston is equipped with a disk part, and at least one cylindrical part of a configuration protruding toward the disk part;

the cylindrical part is arranged so as to be slidable inside the turning-off pressure accumulation chamber;

one end of the turning-off pressure accumulation spring is arranged in contact with the fluid pressure mechanism part on an inner side of the turning-on pressure accumulation chamber with the center of the disk part as a reference, and other end thereof is arranged in contact with the turning-off pressure accumulation piston; and the turning-off pressure accumulation spring is arranged so as to be capable of expanding and contracting inside the hole formed in the disk part of the turning-on pressure accumulation piston.

7. The switchgear driving device according to claim 6, wherein the cylinder accommodating part is formed in a columnar configuration and is arranged inside the turning-on pressure accumulation spring, and is fixed to the bottom section of the spring case;

at a center of the columnar section of the cylinder accommodating part, there is provided the operation cylinder in which the operation piston can slide; and there are provided a plurality of the turning-off pressure accumulation chambers of a cylindrical-hole configuration with the interior side of the spring case being open.

8. The switchgear driving device according to claim 2, wherein the main control valve is provided between the cylinder control chamber and the turning-on pressure accumulation chamber, and is equipped with a switching port connected to the cylinder control chamber, a high-pressure port connected to the turning-on pressure accumulation chamber, and a low-pressure port connected to a low-pressure tank; and, the main control valve is constructed such that by selecting a connection of the switching port to the high-pressure port or the low-pressure port through movement of a valve body, pressure of the cylinder control chamber is controlled.

9. The switchgear driving device according to claim 8, wherein the spring case is formed as a tube one end of which has a bottom section, and, on an open side opposite the bottom section of the spring case, there is installed the fluid pressure mechanism part so as to close the open side.

10. The switchgear driving device according to claim 9, wherein the turning-on pressure accumulation chamber and the turning-off pressure accumulation chamber are each formed in a cylindrical configuration and formed so as to have an open section to an inner side of the spring case.

11. The switchgear driving device according to claim 10, wherein the turning-on pressure accumulation piston is equipped with a disk part having a hole formed at a center thereof, and at least one cylindrical part of a configuration protruding toward the disk part; the cylindrical part is arranged so as to be slidable in the turning-on pressure accumulation chamber, and one end of the turning-on pressure accumulation spring is arranged in contact with the disk part placed on a side opposite the cylindrical part of the turning-on pressure accumulation piston while other end of the turning-on pressure accumulation spring is arranged in contact with the bottom section of the spring case, wherein the turning-off pressure accumulation piston is equipped with a disk part, and at least one cylindrical part of a configuration protruding toward the disk part; the cylindrical part is arranged so as to be slidable in the turning-off pressure accumulation chamber, and one end of the turning-off pressure accumulation spring is arranged in contact with the bottom section of the spring case while other end thereof is arranged in contact with the turning-off pressure accumulation piston.

12. The switchgear driving device according to claim 11, wherein the turning-off pressure accumulation piston is arranged so as to be movable inside the hole formed in the disk part of the turning-on pressure accumulation piston, and, with the center of the turning-on pressure accumulation spring and of the turning-off pressure accumulation spring serving as a reference, the turning-off pressure accumulation chamber and a cylindrical part of the turning-off pressure accumulation piston are arranged on an inner side, and the turning-on pressure accumulation chamber and a cylindrical part of the turning-on pressure accumulation piston are arranged on an outer side, wherein, the operation cylinder is provided on an inner side of the turning-off pressure accumulation chamber of the fluid pressure mechanism part, and the operation cylinder is provided with a large-diameter part in which the operation piston slides, and with, at an end section on a side of the small pressure receiving area chamber, a small pressure receiving area chamber side small-diameter part of a smaller diameter than the large-diameter part;

also at an end section on a side of the cylinder control chamber, there is provided a cylinder control chamber side small-diameter part of a smaller diameter than the large-diameter part; and the turning-off pressure accumulation chamber is connected to the small pressure receiving area chamber side small-diameter part via a conduit line.

13. The switchgear driving device according to claim 12, wherein the operation piston has a sliding part sliding in the large-diameter part of the operation cylinder, and a protrusion provided on the cylinder control chamber side, the protrusion being constructed so as to be gradually diminished in sectional area as it extends away from the sliding part; and on the rod, a diameter-increased part the diameter of which is fixed or gradually increased from the movable electrode side is formed.

14. The switchgear driving device according to claim 13, wherein between the end section of the small pressure receiving area chamber side small-diameter part and the small pressure receiving area chamber side small-diameter part side end section of the large-diameter part of the small pressure receiving area chamber, there is provided a first check valve allowing flow in one direction only from the end section of the small pressure receiving area chamber side small-diameter part to the large-diameter part; and between the end section of the cylinder control chamber small-diameter part and the cylinder control chamber side small-diameter part side end section of the large-diameter part, there is provided a second check valve allowing flow in one direction only from the end section of the cylinder control chamber small-diameter part to the large-diameter part.

* * * * *